United States Patent [19]

Allen

[11] 4,057,707

[45] Nov. 8, 1977

[54] ELECTRIC HEATING UNIT

[75] Inventor: Richard E. Allen, Corning, N.Y.

[73] Assignee: Corning Glass Works, Corning, N.Y.

[21] Appl. No.: 623,419

[22] Filed: Oct. 17, 1975

[51] Int. Cl.[2] ..... H05B 3/16

[52] U.S. Cl. ..... 219/543; 219/409; 219/464; 219/553; 338/308

[58] Field of Search ..... 219/543, 553, 544, 409, 219/443, 462–464; 338/307–308; 252/514, 518; 427/125, 126

[56] References Cited

U.S. PATENT DOCUMENTS

| | | | |
|---|---|---|---|
| 636,203 | 10/1899 | Helberger | 338/293 X |
| 3,349,722 | 10/1967 | Davis | 219/543 X |
| 3,496,336 | 2/1970 | Hingorang et al. | 219/544 X |
| 3,778,305 | 12/1973 | Holmes et al. | 427/126 |
| 3,883,719 | 5/1975 | Hurko | 219/462 X |
| 3,931,496 | 1/1976 | Hurko | 219/543 |

*Primary Examiner*—C. L. Albritton

*Attorney, Agent, or Firm*—Charles W. Gregg; Burton R. Turner; Clarence R. Patty, Jr.

[57] ABSTRACT

An electrical cooking or heating unit comprising a plate of a glassy material including a selected portion thereof upon whose upper surface vessels are to be placed for cooking purposes. The lower surface of the selected portion of the plate is provided with at least one sinuous strip of a gold/platinum alloy which integrally forms the electrical resistance heating element for the heating or cooking unit. A porous and partially sintered overglaze or coating covers the heating element and the portion of the lower surface of the plate on which the heating element is provided, such glaze preventing or inhibiting cracking, peeling or agglomeration of the heating element to provide a resultant increase in electrical resistivity. The life of the heating or cooking unit is thereby substantially increased.

6 Claims, 2 Drawing Figures

ELECTRIC HEATING UNIT

BACKGROUND OF THE INVENTION

In U.S. Pat. No. 3,067,315, issued Dec. 4, 1962 to Bohdan Hurko, there is disclosed a heating unit comprising a glass-like base member with a narrow continuous strip of multi-layer film bonded to such member, such film comprising at least one inner layer of platinum and an outer layer of gold so that the total resistance of the narrow strip is approximately equal to the low resistance of the outer gold layer. In putting heating units such as covered by the patent to Hurko on so-called life tests, it was found that the multi-layer films cracked, peeled or agglomerated at early points in such tests thereby giving an intolerable increase in the electrical resistivity of the films. Accordingly, the heating units such as herein disclosed were developed.

It is, therefore, an object of the present invention to provide new and novel electric heating units which are relatively durable.

It is another object of the present invention to provide electric heating units whose heating elements are substantially protected against cracking, peeling or agglomeration thereof.

Other objects and characteristic features of the invention will become apparent as the description proceeds.

SUMMARY OF THE INVENTION

The invention is believed to be adequately summarized in the foregoing abstract of the disclosure and, therefore, in order to avoid repetition or redundancy to the extent possible, no further summary of the invention is considered necessary nor will any be given.

BRIEF DESCRIPTION OF THE DRAWINGS

In the drawings.

Similar reference characters refer to similar parts in each of the FIGS. of the drawings.

PREFERRED EMBODIMENTS OF THE INVENTION

Figure 1:
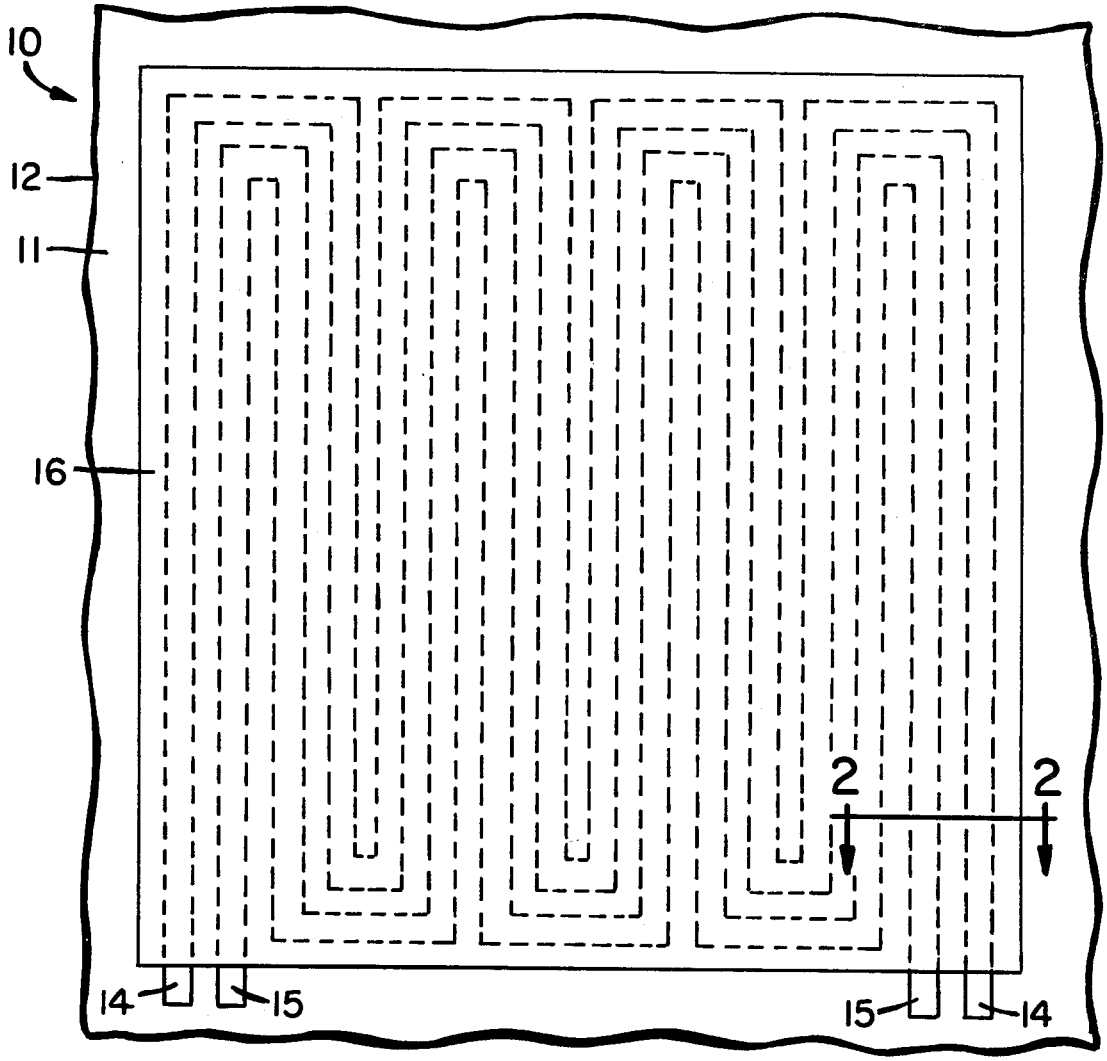
FIG. 1 is a bottom plan view of a heating unit embodying the present invention and illustrating the sinuous strip heating element affixed to the underside of a plate of a glassy material.
Figure 2:
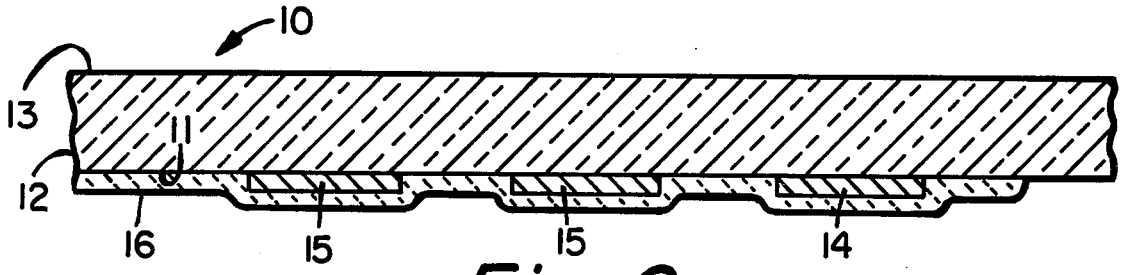
FIG. 2 is a sectional elevational view on an enlarged scale and taken generally along line 2—2 of FIG. 1.

Referring to the drawings in detail, there is shown in FIG. 1 a lower surface 11 of a portion 12 of a relatively thin flat plate 10 of a glassy material, such portion 12 being selected as a heating portion upon whose smooth upper surface 13 (FIG. 2) vessels are to be placed for cooking purposes. Plate 10 may, for example, be a smooth glassceramic cook-top of a kitchen range, such cook-tops being now well-known in the art. A pair of first and second electrical resistance strips or heating elements 14 and 15 extend in patterns parallel or adjacent to each other in sinuous, winding, serpentine or back and forth paths over part of surface 11 of portion 12 of panel 10, such strips being made to be integral with said part of surface 11 as discussed below.

A silk screen having the desired pattern for the heating elements was disposed against surface 11 of portion 12 of plate 10 and, by the use of well-known silk screen techniques, there was applied, through said pattern of the silk screen and to said surface 11, the desired electrical resistance strips 14 and 15 which, at this time, comprise a liquid mixture of organic platinum and gold paints. The mixture was selected so that the finally formed strips such as 14 and 15 would each be an alloy comprising, by weight, about 95% platinum and 5% gold.

As a specific example, to obtain the desired alloy for the strips such as 14 and 15, 30 parts, by weight, of bright platinum organic paint were thoroughly mixed with 0.66 parts, by weight, of bright gold organic paint, such paints being obtained from Engelhard Industries, Electrometallic Division, under Numbers 7813 and 6340, respectively. The address of such company is 1 West Central Avenue, East Newark, N.J. 07029. Following the thorough mixing of the paints, the mixture was silk screened onto surface 11 of portion 12 of plate 10, as mentioned above. Said platinum paint #7813 and gold paint #6340 contain, by weight, 7.5% platinum and 18% gold, respectively, and therefore, said 30 parts of the platinum paint mixed with said 0.66 parts of the gold paint resulted in the above mentioned finally formed strips comprising, by weight, about 95% platinum and 5% gold.

To volatize or drive off the organic constituents of the paints and leave the desired gold/platinum alloy strips 14 and 15 in the sinuous pattern desired on surface 11 of portion 12 of plate 10, such plate was then subjected to heat treatments comprising, baking of such plate for about 15 minutes at about 125° C. in a well ventilated oven and then firing such plate in a furnace to about 700° C. for about 5 minutes. This resulted in a plate such as 10 with well adhered gold/platinum alloy electrical resistance heating elements integral with surface 11 of the plate.

Following the above steps there was ground, as by using a ball mill and to an average particle size of about 1 to 10 microns, a quantity of a glassy material having as its composition, by weight, 20 parts ZnO, 25 parts $Al_2O_3$, 55 parts $SiO_2$ and 2 parts $Cs_2O$. Such material is disclosed in copending application, Ser. No. 614,798, filed Sept. 19, 1975, by Francis W. Martin et al. and entitled Electric Heating Units which application is now U.S. Pat. No. 3,978,315 issued Aug. 31, 1976. In order to make a slurry, the ground glassy material was then mixed with a quantity of Number 324 squeegee oil which is obtainable from B. F. Drakenfeld and Company whose address is Washington, Pa. 15301. The thoroughly mixed slurry was then silk screened over the heating elements comprising sinuous strips 14 and 15 applied to surface 11 of portion 12 of plate 10, it being made certain that all of the heating elements except the terminal ends of strips 14 and 15 were entirely covered. Plate 10 was then fired for about 100 seconds at about 950° C. and subjected to a ceramic heat treatment for about 1 hour at about 840° C. This resulted in a porous, partially sintered overglaze or coating 16 (FIG. 2) about 0.002 inch in thickness and covering the sinuous heating element or elements and a small part of surface 11 surrounding such element or elements. This coating or overglaze 16 prevents or inhibits the previously mentioned cracking, peeling or agglomeration, of the heating elements during the use of heating or cooking units incorporating same. It is not known for certain why the overglaze or coating such as 16, operates as it does but heating units incorporating the heating elements and overglaze such as herein described have been found to pass the previously mentioned so-called life tests without cracking, peeling or agglomeration of the heating elements.

Further work has disclosed that heating elements, such as 14 and 15, comprising other gold/platinum alloys can be satisfactorily employed. For example, heating elements such as 14 and 15 and comprising, by weight, from about 90 to 98% platinum with the remainder being substantially gold, have successively passed the previously mentioned life tests when covered by the porous, partially sintered overglaze or coating such as 16 discussed above.

Furthermore, it has been found that heating elements of gold/platinum/rhodium alloys comprising, by weight, about 91 to 94% platinum, 1 to 4% rhodium and 5% gold have increased resistance to burnout when covered by the porous, partially sintered overglaze disclosed herein. Such elements may be made by adding the required number of parts of a rhodium resinate solution to the previously discussed bright platinum and gold organic paints when they are being mixed. Such a rhodium resinate solution is also obtainable from the previously mentioned Electrometallic Division of Engelhard Industries under the Number A-1120 and contains, by weight, 5% rhodium.

Although it is set forth that the liquid metallic or organic paints and the resinate solutions were and may be obtained from the company specified, such paints and solutions can, of course, be obtained from other companies. In such case, the number of parts of the gold and platinum paints (and rhodium solutions) which are used in producing the final alloys for the heating elements such as 14 and 15 will probably have to be changed. This will be readily apparent to those skilled in the art and can, of course, be determined by a minimum amount of calculation.

In conclusion it should be pointed out that the noble metal alloy heating elements such as herein disclosed may, at times, be patterned in extremely narrow widths and, in such case, there is the possibility that small contaminates such as one or more specks of dust may in some manner get into or be incorporated into one or more of said narrow width elements. This could cause an intolerably high resistance point or points, or electrical discontinuity as is believed relatively apparent. For this reason it has been found, at times, such as when the heating elements are extremely narrow in width as mentioned above, that it is expedient to superimpose a second pattern of heating elements in contact with, and precisely over and coinciding with an applied first pattern thereof so that said electrical discontinuities or high resistance points are avoided or bypassed as will be readily apparent to those skilled in the art.

Although there is herein described in detail only a few forms of a heating element embodying the invention, it will be understood that such is not intended to be in any way limiting but that various changes and modifications may be made therein within the purview of the appended claims without departing from the spirit and scope thereof.

What is claimed is:

1. An electrical cooking or heating unit comprising;

I. a thin flat plate of a glassy material and having relatively smooth upper and lower surfaces with a portion of said plate selected as a heating portion upon whose upper surface vessels are to be placed for cooking purposes;

II. an electrical resistance heating element integral with said lower surface of said selected portion of said plate, such heating element being formed of at least one sinuous strip of an electrical resistance alloy comprising by weight from about 90 to 98% platinum with the remainder being substantially gold; and III. a porous and partially sintered glaze covering said heating element and integral with such element and said lower surface of said selected portion of said plate.

2. An electrical cooking or heating unit in accordance with claim 1 and in which said alloy comprises by weight about 95% platinum and 5% gold.

3. An electrical cooking or heating unit in accordance with claim 1 and in which said alloy comprises by weight about 91 to 94% platinum, 5% gold and 1 to 4% rhodium.

4. In combination with a flat and relatively smooth thin glass-ceramic plate for a cooking or heating unit and having a portion thereof selected to provide a heating portion having an upper surface for supporting vessels for cooking purposes, a heating element integral with the lower surface of said selected portion of said plate, such element including;

I. at least one sinuous strip of an electrical resistance heating alloy comprising by weight from about 90 to 98% platinum with the remainder being substantially gold; and II. a porous partially sintered glaze integrally covering said electrical resistance heating alloy and part of said lower surface of said selected portion of said plate.

5. A plate and heating element in accordance with claim 4 and in which said alloy comprises by weight about 95% platinum and 5% gold.

6. A plate and heating element in accordance with claim 4 and in which said alloy comprises by weight about 91 to 94% platinum, 5% gold and 1 to 4% rhodium.

* * * * *